United States Patent [19]

Simi et al.

[11] Patent Number: 4,999,935

[45] Date of Patent: Mar. 19, 1991

[54] HYDRAULIC SYSTEM AND APPARATUS FOR USE WITH VEHICLE ACCESSORY UNITS

[75] Inventors: Edward A. Simi, Portage; Gary E. Watson, Mequon, both of Wis.

[73] Assignee: Douglas Dynamics, Inc., Milwaukee, Wis.

[21] Appl. No.: 531,523

[22] Filed: May 31, 1990

[51] Int. Cl.[5] ..... E01H 5/04

[52] U.S. Cl. ..... 37/236; 37/234; 37/DIG. 11

[58] Field of Search ..... 37/231, 234, 235, 236, 37/DIG. 11

[56] References Cited

U.S. PATENT DOCUMENTS

| | | | |
|---|---|---|---|
| 3,201,878 | 8/1965 | Markwardt . | |
| 3,307,275 | 3/1967 | Simi . | |
| 3,587,750 | 6/1971 | Cantral et al. . | |
| 3,706,144 | 12/1972 | Miceli . | |
| 4,028,820 | 6/1977 | Simonds, Jr. | 37/234 |
| 4,304,057 | 12/1981 | Watson et al. . | |
| 4,439,939 | 4/1984 | Blau | 37/234 X |
| 4,554,751 | 11/1985 | Nicolosi et al. | 37/234 |
| 4,727,665 | 3/1988 | Verseef | 37/236 |
| 4,807,375 | 2/1989 | Iraci | 37/236 |

*Primary Examiner*—Dennis L. Taylor
*Assistant Examiner*—J. Russell McBee
*Attorney, Agent, or Firm*—Michael, Best & Friedrich

[57] ABSTRACT

This patent relates to a hydraulic system for a vehicle mounted, power operated plow blade. The power unit attached to the vehicle in the front bumper area includes a fluid reservoir, a pump in the reservoir and the lift cylinder for producing vertical movement of the blade. The hydraulic system includes four way, three way, and two way valves, all along with the necessary passages and ports provided in a unitary, manifold block attached directly to the side of the power unit. The four way valve controls flow to and from the reservoir relative to the three way valve and one of the angling cylinders for the blade. The three way controls flow to and from the four way valve relative to the other angling cylinder and the lift cylinder. The two way valve controls fluid flow to and from the lift cylinder relative to the three way valve. An adjustable restrictor valve is included in the hydraulic circuit between the lift cylinder and return flow from the lift cylinder to the reservoir to allow control over the lowering action of the blade. A cushion valve is positioned in the flow passages and between the two angling cylinders to allow fluid flow from the pressurized angling cylinder to the angling cylinder which would not ordinarily be pressurized; this is to accommodate the condition where the extended edge of the blade strikes an obstacle in that the non-pressurized cylinder will be pressurized through the cushion valve causing the blade to angle opposite to the set orientation and thereby prevent damage to the blade and/or system.

18 Claims, 3 Drawing Sheets

HYDRAULIC SYSTEM AND APPARATUS FOR USE WITH VEHICLE ACCESSORY UNITS

BACKGROUND OF THE INVENTION

This invention relates to vehicle accessory units such as snowplows and the like and, more particularly, to hydraulic power systems adapted to operate such accessory units.

Hydraulic systems for controlling, for example, the operative position of vehicle mounted snowplow blades are well known. These systems generally allow for varying the vertical position of the plow blade and, when in a plowing mode, the angular relationship of the plow blade relative to the path travel of the vehicle. An example of such a system is found in U.S. Pat. No. 3,307,275, issued to E.A. Simi and assigned to the assignee of this application.

Ease of installation and removal of the plow blade, its support and positioning elements, have become major considerations in recent years, along with the usual movement to simplify and improve such units. This is particularly true in connection with snowplows intended for use with relatively small vehicles such as Jeep vehicles and pickup trucks. Movement in this direction is a result of a recognition that the need for plow assemblies is seasonal and safe storage of the assemblies when not in use, either during or out of season, can extend the life of the components. Therefore, in addition to the usual movement to continually simplify the construction, there is a developing recognized need to provide for removal of the assembly from the vehicle.

This invention recognizes that those objectives, simplicity and ease of installation and removal, can be furthered by making the controls electrical. In the past, mechanical manipulation systems, such as wire extensions commonly referred to as push-pull cables, were used to activate the hydraulic power unit and to sequence the valves controlling movement to various blade orientations. A prior U.S. Pat. No. 3,706,144, issued to Marc L. Miceli discloses an electrical, solenoid operated hydraulic system embodied in a snowplow assembly of the type to which this invention relates.

SUMMARY OF THE INVENTION

A general object of this invention is to simplify the construction and improve the operation of a hydraulic power system for a vehicle accessory unit.

Another general object of this invention is to provide an improved vehicle accessory unit of this type.

A further object of this invention is to simplify and facilitate the assembly to and removal from a vehicle of the hydraulic power system.

A still further, more specific, object of this invention is to increase the versatility, operating life and applicability of a hydraulic power system of this type.

For the achievement of these and other objects, this invention proposes a hydraulic power system having the hydraulic system controls in a generally unitary, compact manifold assembly. In a vehicle mounted plow blade application, the conventional gear pump of the unit is positioned in a hydraulic fluid reservoir, both of which are integral parts of the power unit. The manifold attaches directly to the power unit. With this construction, the channeling for the lift cylinder, which is part of the power unit, can be confined within the power unit or specifically in the reservoir walls. This simplifies the construction. Furthermore, the principal elements of the hydraulic control system are included in the manifold, i.e., the channels providing the flow passages, the valves for controlling flow, and the ancillary system units such as check valves. This makes the hydraulic system components, directly attachable to the basic power unit. Preferably, the manifold communicates with the lift cylinder through relatively engaged ports on the power unit body and on a manifold wall. Also, in accordance with the preferred embodiment, the manifold communicates with the angling cylinders through hydraulic lines connected directly to ports in the side wall of the manifold. All of the hydraulics and attendant system components such as cylinders, hydraulic lines, reservoir, etc., are forward of the vehicle, e.g., not under the vehicle hood, and the hydraulic system control elements, flow passages and control valves, are movable with the power unit.

Other objects and advantages will be pointed out in, or be apparent from, the specification and claims, as will obvious modifications of the embodiments shown in the drawings.

DESCRIPTION OF THE PREFERRED EMBODIMENT

The hydraulic system and power unit of this invention will find particular application in a vehicle snowplow accessory unit to control raising, lowering, and angling of the snowplow blade. For that reason, it will be described in such an arrangement but it will be appreciated that the power unit has more general utility and is not specifically limited to use with any particular apparatus.

Figure 1:
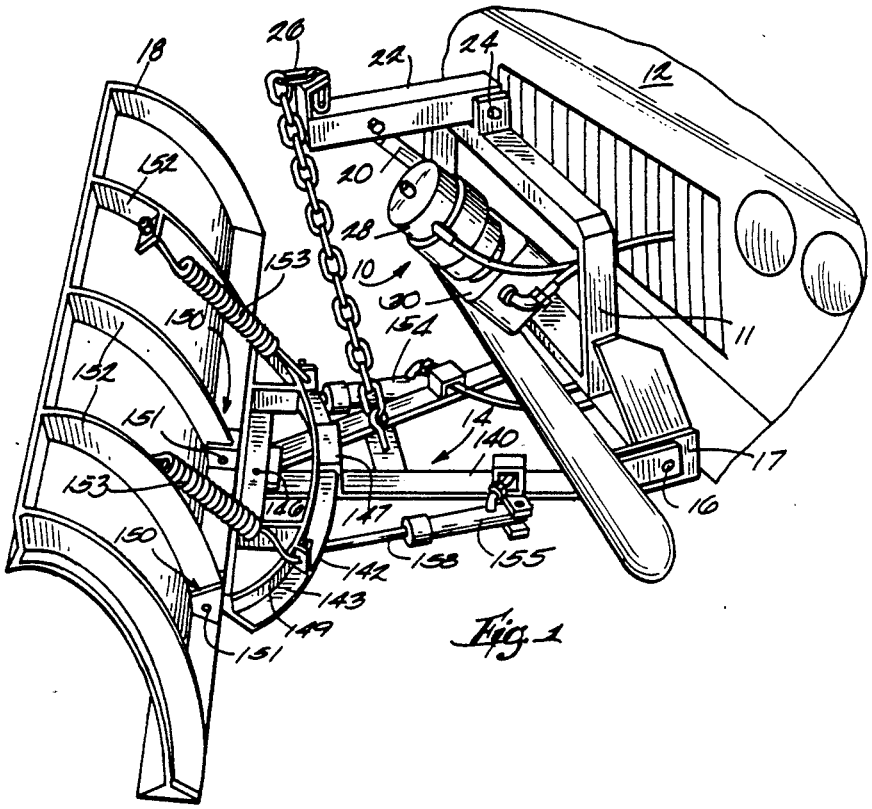
FIG. 1 is a perspective view of a prior art vehicle accessory unit of the type to which this invention relates.
Figure 2:
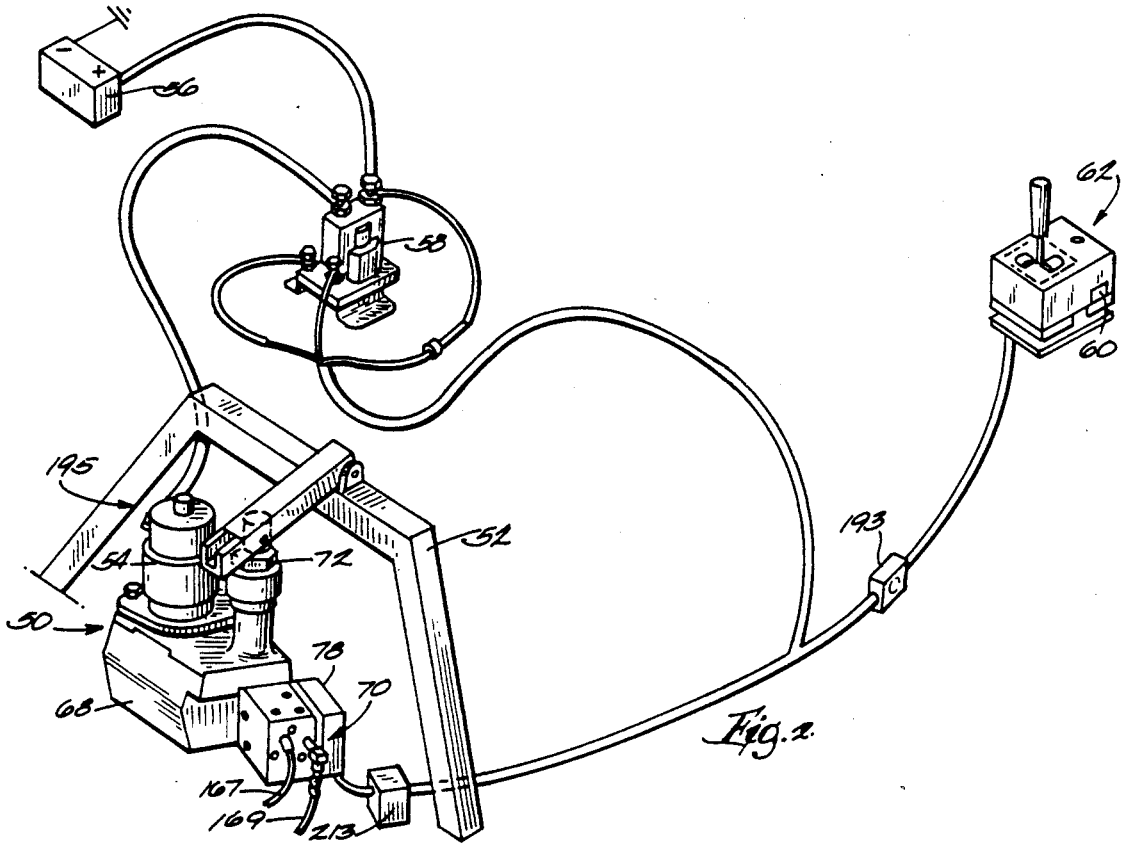
FIG. 2 is a perspective view of a power system constructed in accordance with this invention.

FIG. 1 illustrates a prior art type unit which is disclosed in Simi U.S. Pat. No. 3,307,275 mentioned above.

With particular reference to the drawings, lift unit 10 is supported in a frame 11 suitably connected to the front of vehicle 12 in the area of the front bumper. Frame 14 is pivotally connected by pins 16 (only one visible in the drawing) to an extension 17 attached to the vehicle frame (not shown) and supports a snowplow blade 18 for movement about vertical and horizontal axes in a manner to be described more completely hereinafter. Vertical movement of plow blade 18 about a horizontal axes defined by pins 16 is achieved by movement of ram 20 of a hydraulic cylinder provided as part of the power unit. Ram 20 is connected to frame 14 through a lever arm 22 which is in turn pivotally connected to frame 11 by pivot pin 24. Lever arm 22 is connected to frame 14 by chain 26. From the illustration of FIG. 1 it will be evident that extension of ram 20 raises plow blade 18 whereas the snowplow is lowered when ram 20 retracts into the power unit.

The power unit includes two basic subassemblies, drive motor assembly 28 and hydraulic power assembly 30 which includes ram 20. Drive motor assembly 28 can, for example, be a conventional electric motor operated from the vehicle battery. A portion of hydraulic power assembly 30 defines an interior hydraulic fluid reservoir and includes a pump in the reservoir (neither the reservoir nor the pumps are shown in FIG. 1). Motive power is transmitted to the pump which provides fluid to either lift cylinder 20 or angle cylinders 154 or 155.

The system is capable of producing horizontal movement of snowplow blade 18. In this connection, frame 14 includes an A-frame portion 140 which is pivotally connected by pins 16 to extension 17 and an arcuate frame portion 142 connected to plow blade 18. Frame portion 142 is connected to and pivots relative to the A-frame about a vertical pivot axis defined by pin 146. Three clevices 150 are provided as part of the arcuate frame portion and are connected to vertical ribs 152 of the plow blade by pins 151 to permit limited pivotal movement of the plow blade in the event the blade should strike an obstruction such as a rock or the like. Coil springs 153 are connected between the plow blade and the arcuate frame portion to return the blade to its normal position after the obstruction is cleared. Hydraulic cylinders 154 and 155 are connected between frame portion 142 and the A-frame and operation of these hydraulic cylinders is effective to pivot the plow blade horizontally about pin 146 to a desired plowing angle.

Reference will now be made to FIGS. 2–7, wherein the hydraulic system of this invention is illustrated without the vehicle, the plow blade, and the major portion of the connections of the blade to the vehicle.

Power unit 50 is supported on frame portion 52, which would be attached to the vehicle such as that illustrated in FIG. 1 but not shown in this figure. For purposes of illustration, power unit 50 and frame 52 can be viewed as replacing power unit 10 and frame 11 in FIG. 1.

Power unit 50 includes a drive motor 54 connected to the vehicle battery 56 through a conventional solenoid assembly 58. The solenoid assembly 58 is activated by an on/off switch 60 which is part of lever control 62 located in the vehicle cab. A reservoir 64 and pump 66 in fluid communication with the reservoir are located in base 68 and are shown schematically in FIGS. 3A and 4–7.

A valve manifold 71 bolts directly onto base 68 and contains the valving, porting, flow passages and ancillary mechanisms for selectively directing fluid to lift cylinder 72 and angle cylinders 74 and 76. The construction and operation will be described hereinafter.

Incorporating the valves, ports and ancillary mechanisms in a generally unitary manifold assembly simplifies the system. Moreover, when it is necessary to remove the power unit, the major portion of the hydraulics of the system are removed as a unit.

Before proceeding with a more detailed description, it should be noted that the actual control valves are solenoid operated, thus electrically controlled and further simplifying the overall structure. The solenoid actuators are schematically illustrated in FIGS. 4–7 and are housed on manifold 70 under a removable cover 78.

Reference will now be made to FIGS. 4–7 for a description of the hydraulic system and its operation. Solenoid operated four way valve 80, three way valve 82, and two way valve 84 are the principal components of the system.

Figure 3A:
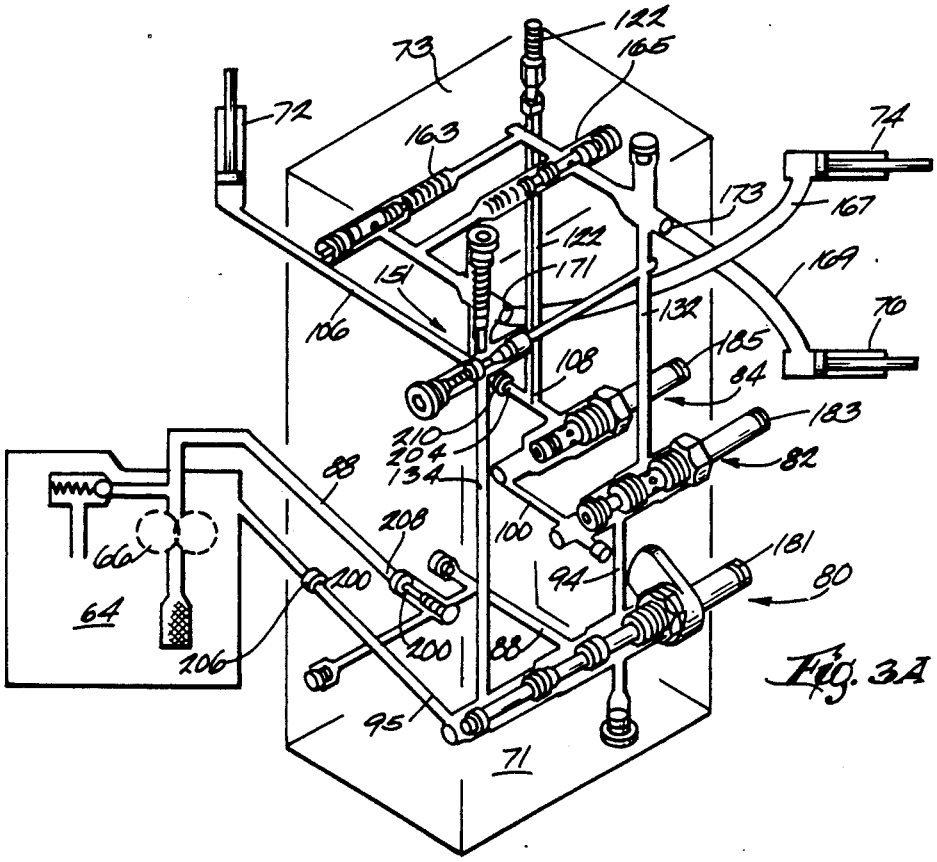
FIG. 3A is an open or transparent view of the manifold exposing the channels, valves, etc.
Figure 4:
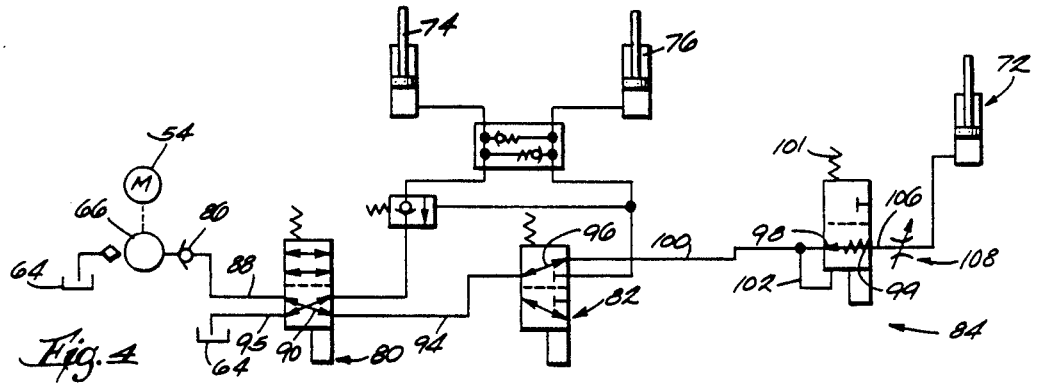
FIGS. 4–7 are schematics of the system illustrating the hydraulics in various modes of operation.

FIG. 4 illustrates the condition for a raise blade cycle. Pump motor 54 and only four way valve 80 of the valves are energized. Fluid flows under the influence of pump 66 to lift cylinder 72 via check valve 86, conduit 88, valve passage 90, passage 94, valve passage 96 of the three way valve passage 100, valve passage 98 of the two way valve and conduit 106. The two way valve, in addition to being a solenoid valve, has pilot capability to shift against spring 99 to establish a flow passage to the lift cylinder. When passage 100 is pressurized, that pressure is transmitted to the valve spool (visible in FIG. 3A) through passage 102 to overcome spring 101 and connect passage 98 between passages 100 and 106. When pressure in passage 100 is interrupted, the spring returns valve 84 to a blocking mode until the solenoid is energized. Conduit 106 contains quill operated restrictor valve 108 the operation of which will be described hereinafter. This pressurizes cylinder 72 to extend its ram and raise the blade.

Figure 5:
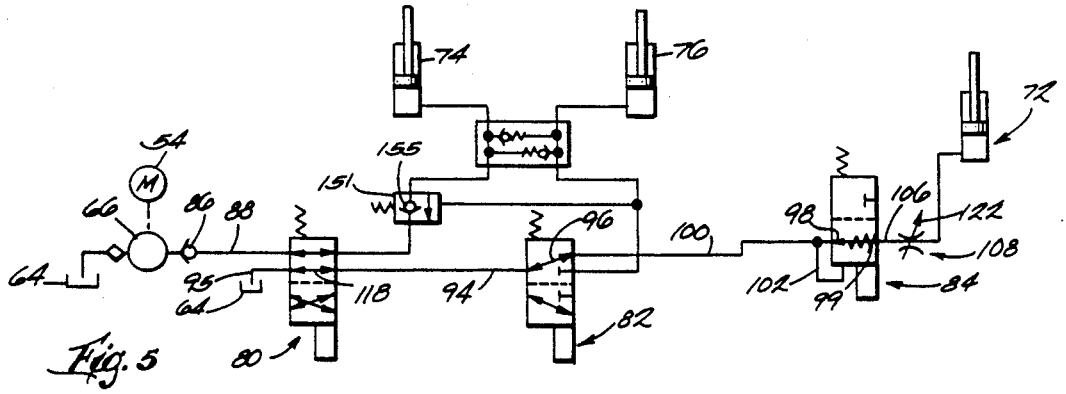

The lower blade mode is illustrated in FIG. 5, in this mode the blade is also capable of floating up and down as no pressure is applied to cylinder 72. In this mode, the motor 54 and pump 66 are de-energized and of the valves only two way valve 84 is energized. This creates a flow path back to the reservoir which allows the plow blade to lower under its own weight and that of the A-frame. More particularly, the path is through restrictor valve 108, two way valve passage 98, conduit 100, three way valve passage 96, conduit 94, and four way valve passage 118, to reservoir 64. Restrictor valve 108 includes a quill 122, represented by the arrow in FIGS. 4–7 and more completely illustrated in FIG. 3A. By manipulating the quill, the rate of flow in conduit 106 and thus back to the reservoir can be varied.

Figure 6:
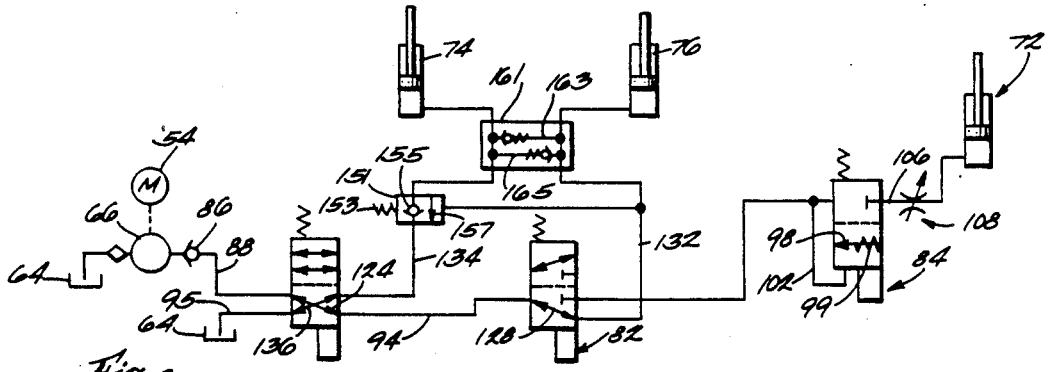

FIG. 6 illustrates the angle blade to left mode, to the left is relative to the driver who will be sitting in the vehicle behind the blade system. In this mode, motor 54 and pump 66 are energized and both four way and three way valves 80 and 82 are energized. A flow path to energize cylinder 76 is completed. Flow is from pump 66, through check valve 86, conduit 88, four way valve passage 124 conduit 94, three way valve passage 128, and conduit 132 to cylinder 76. The ram of cylinder 76 is extended. Simultaneously, the ram of cylinder 74 will be forced back into its cylinder displacing any fluid in that cylinder and causing it to flow back to reservoir through a return path including conduit 134 and four way valve passage 136.

Figure 7:
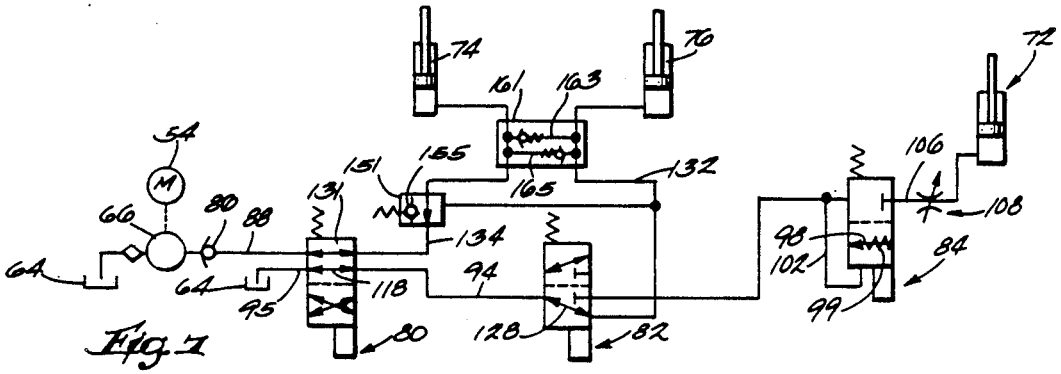

The angle blade right mode is illustrated in FIG. 7. In this mode, a fluid flow path to pressurize cylinder 74 is established. Motor 54 and pump 66 are energized and of the valves only three way valve 82 is energized. The flow path is through check valve 86, valve passage 131, conduit 134 to cylinder 74 to extend the ram of that cylinder. Simultaneously, the ram of cylinder 76 is forced back into the cylinder and fluid returns through conduit 132, three way valve passage 128, conduit 94 and four way valve passage 118 to reservoir 64.

In both angle modes, the flow path to lift cylinder 72 is interrupted in the three way valve 82.

Valve 151 in conduit 134 is a poppet check valve (see FIGS. 6 and 7). It is biased to the positions in FIGS. 6 and 7 by spring 153, i.e., with check valve 155 in circuit. When pressure is on cylinder 76 through conduit 132, fluid pressure is transmitted to valve 151 through conduit 159 to overcome spring 153 and shift the check valve to make a return flow path to reservoir through passage 157. The other function of this valve comes into play when the blade is being raised while stacking snow. That is, when snow is being stacked, the blade will be repeatedly raised and lowered to elevate quantities of snow into a snow stack. During this operation, fluid in cylinder 74 could bleed back to the reservoir, check valve prevents that. Fluid cannot bleed back from cylinder 76 because the flow path is interrupted in three way valve 82.

A cushion valve assembly 161 is connected between conduits 132 and 134. This valve assembly is provided to accommodate pressure increases in the pressurized or extended cylinder when the forwardly projecting plow blade strikes an obstacle.

Again refer to FIGS. 6 and 7. The cushion valve assembly has two spring loaded check valves 163 and 165. With the blade angled left, FIG. 6, when the extended portion of blade (the right edge not shown) strikes an obstacle it tends to collapse the ram of cylinder 76 into the cylinder. This builds the pressure in conduit 132 and when that pressure exceeds the spring force in check valve 165, the ball unseats allowing fluid to flow to conduit 134 and pressurize cylinder 74. This extends the ram of the opposite side cylinder 74, the blade angles in the opposite direction preventing damage to the blade system. After the obstacle is cleared, the system will equalize.

The opposite will happen when the blade is angled right, i.e., the extended left edge of the blade (not shown) strikes an obstacle. In that case, valve 165 will unseat under increased pressure and pressurize cylinder 74 to oppositely angle the blade to prevent damage.

Figure 3B:
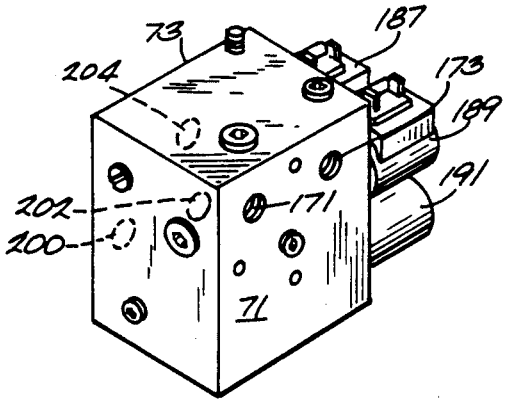
FIG. 3B is a view of the manifold.

FIGS. 3A and 3B show the actual structural relationships within the valve manifold, i.e., valves, ports and flow channels. The components have been numbered the same as in the schematics of FIGS. 4–7.

Figure 8:
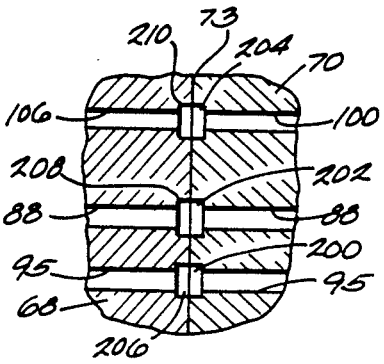
FIG. 8 is a portion of the abutting manifold and power unit base illustrating the register of relevant ports, with specific seal details, etc. eliminated.

With reference to FIGS. 3A and B, hydraulic conduits 167 and 169 (also see FIG. 2), which make the external hydraulic connection to cylinders 74 and 76, connect to the manifold 70 through ports 171 and 173 in wall 71 of the manifold. Ports 200, 202 and 204 in wall 73 of manifold register with ports 206, 208 and 210 in the wall 69 of the power unit base 68. For simplicity, ports 206, 208 and 210 are only shown schematically in FIG. 3A, but it is apparent from FIG. 8 that these registering ports are in engaging walls of the manifold and the power unit base and register with each other.

Referring now specifically to FIG. 3A and with reference to FIGS. 4–7 as may be required, the operational modes will be described in the context of the manifold structure.

In the lift mode, hydraulic fluid flows from reservoir 64 under the influence of pump 66 through passage 88 and check valve 86 to four way valve 80. From valve 80 through passage 94 to three way valve 82 and from valve 82 through passage 100 to two way valve 84. From the two way valve the fluid flows through restrictor valve 108, to and through ports 204 and 210 and passage 106 to pressurize cylinder 72.

In lower blade mode, fluid returns through passage 106, restrictor valve 108, two way valve 84, passage 100, three way valve 82, passage 94, four way valve 80 and passage 95 to reservoir 64.

In the angle left mode, the flow path is again to the four way valve through passage 88 and through the four way valve to passage 94. In this mode, the three way valve directs flow from passage 94 to passage 132 to port 173 and conduit 169 to pressurize cylinder 76. In this mode, a return flow path from cylinder 74 is defined through conduit 167, port 171, passage 134, four-way valve 80 and passage 95 to reservoir 64.

In the angle right mode, the flow path is again to the four-way valve through passage 88. From the four-way valve it proceeds through passage 134, to port 171 and conduit 167 to pressurize cylinder 74. The return flow path for cylinder 76 is through conduit 169, port 173, passage 132, three-way valve 82, passage 94, four-way valve 80, passage 95 to the reservoir.

The check valves 163 and 165 of the cushion valve 161 and poppet check valve 151 are also visible in FIG. 3A.

FIG. 3A also shows the armatures 181, 183, and 185 of the solenoids of valves 80, 82, 84. FIG. 3B illustrates the coil cartridges 187, 189, 191 of the solenoids. In use, the coil cartridges are covered by cap 78.

The manifold being attached to the power unit base results in a unitary, compact power unit. All the principal hydraulic channeling for the hydraulics is in the power unit and manifold and all hydraulics are otherwise forward of the power unit, i.e., not under the vehicle hood. This does not require connections which have to be manipulated from lines which are to be left on the vehicle if the power unit and A-frame and blade are removed from the vehicle. The electrical connections to the power unit could be made by quick disconnects 193, 195, and 213.

By using the three way valve to control flow to and from the lift cylinder as well as controlling flow for angling, the hydraulic system is simplified. Also, the use of the pilot solenoid valve 84, the cushion valve 161, and the poppet check valve 151 eliminates channeling and simplifies the overall system.

Although this invention has been illustrated and described in connection with particular embodiments thereof, it will be apparent to those skilled in the art that various changes and modifications may be made therein without departing from the spirit of the invention or from the scope of the appended claims.

We claim:

1. A hydraulic system comprising, in combination, a plow blade, means for mounting said plow blade for vertical movement and horizontal movement, a hydraulic power unit including a hydraulic fluid reservoir, a pump communicating with said hydraulic fluid reservoir and lift hydraulic cylinder means, means connecting said lift hydraulic cylinder to said plow blade for moving said plow blade vertically, angling hydraulic cylinder means for selectively moving said blade horizontally in opposite directions, a manifold including means defining fluid flow passages in said manifold communicating with said hydraulic cylinder means and solenoid valve means in said fluid flow passages and operative to selectively direct fluid to said lift hydraulic cylinder means and angle hydraulic cylinder means, and said manifold connected to and mounted on said hydraulic power unit.

2. The hydraulic system of claim 1 wherein said solenoid valve means include a four way valve, a three way valve and a two way valve, said two way valve controlling fluid flow to said lift cylinder, said three way valve alternatively directly fluid flow to said two way valve and one of said angling cylinders, and said four way valve controlling flow to said three way valve and the other of said angling cylinder means.

3. The hydraulic system of claim 2 including means defining first port means in said power unit, means defining passage means in said power unit communicating said first port means with said lift cylinder means and with said reservoir, means defining second port means in said manifold and connected to said first port means in said power unit, said means defining passages in said manifold defining passages communicating said four way, three way and two way valves with said second port means.

4. The hydraulic system of claim 3 wherein said first port means is defined in a side wall of said power unit, and said second port means are defined in a side wall of said manifold and register with said first port means.

5. The hydraulic system of claim 4 including means defining additional port means in a side wall of said manifold and means associated with said additional port means for receiving conduit means for connecting said additional port means to said angling cylinder means.

6. The hydraulic system of claim 5 wherein said four-way, three-way and two-way valves are selectively operable to provide a first mode of operation wherein said four way valve directs fluid flow only to said three way valve, said three way valve directing flow to said two way valve, and said two way valve directs fluid flow to said lift cylinder means, a second mode of operation wherein said two way valve directs fluid returning from said lift cylinder means to said three way valve, said three way valve directs said return fluid flow to said four way valve, and said four way valve directs said return fluid flow to said reservoir, a third mode of operation wherein said three way valve interrupts flow to said two way valve and establishes a flow path to one of said angling cylinder means, said four way valve establishes a flow path from said pump to said three way valve and from said other angling cylinder means to said reservoir, and a fourth mode of operation wherein said three way valve interrupts flow to said two way valve and establishes a path to one of said angling cylinder means, and said four-way valve establishes a flow path from said pump to the other of said angling cylinder means and a flow path from said reservoir to said three-way valve.

7. The hydraulic system of claim 6 including cushion valve means between said angling cylinder means and operative to establish a flow path from the angling cylinder means connected to said pump to said other angling cylinder means when a predetermined force is applied to said angling cylinder means connected to said pump which is in opposition to the fluid pressure from said pump.

8. The hydraulic system of claim 2 wherein said four way, three way and two way valves are selectively operable to provide a first mode of operation wherein said four way valve directs fluid flow only to said three way valve, said three way valve directing flow to said two way valve, and said two-way valve directs fluid flow to said lift cylinder means, a second mode of operation wherein said two-way valve directs fluid returning from said lift cylinder means to said three way valve, said three way valve directs said return fluid flow to said four way valve, and said four way valve directs said return fluid flow to said reservoir, a third mode of operation wherein said three way valve interrupts flow to said two way valve and establishes a flow path to one of said angling cylinder means, said four way valve establishes a flow path from said pump to said three way valve and from said other angling cylinder means to said reservoir, and a fourth mode of operation wherein said three way valve interrupts flow to said two way valve and establishes a path to one of said angling cylinder means, and said four way valve establishes a flow path from said pump to the other of said angling cylinder means and a flow path from said reservoir to said three way valve.

9. The hydraulic system of claim 8 including cushion valve means between said angling cylinder means and operative to establish a flow path from the angling cylinder means connected to said pump to said other angling cylinder means when a predetermined force is applied to said angling cylinder means connected to said pump which is in opposition to the fluid pressure from said pump.

10. The hydraulic system of claim 7 including adjustable means in the passage from said two-way valve to said lift cylinder means for adjusting the rate of flow in that passage.

11. The hydraulic system of claim 6 wherein said two way valve means includes pilot means connected in the flow passage to said two way valve means, said pilot means operative in response to pressure in the flow passage to said two way valve means to operate said two way valve means to establish a flow passage to said lift cylinder means to pressurize said lift cylinder means.

12. The hydraulic system of claim 8 wherein said two way valve means includes pilot means connected in the flow passage to said two way valve means, said pilot means operative in response to pressure in the flow passage to said two way valve means to operate said two way valve means to establish a flow passage to said lift cylinder means to pressurize said lift cylinder means.

13. A hydraulic system comprising, in combination, a plow blade, means for mounting said plow blade for vertical movement and horizontal movement, a hydraulic power unit including a hydraulic fluid reservoir, a pump communicating with said hydraulic fluid reservoir and lift hydraulic cylinder means, means connecting said lift hydraulic cylinder to said plow blade for moving said plow blade vertically, angling hydraulic cylinder means for selectively moving said blade horizontally in opposite directions, hydraulic flow means defining fluid flow passages communicating with said hydraulic cylinder means and solenoid valve means in said fluid flow passages and operative to selectively direct fluid to said lift hydraulic cylinder means and angle hydraulic cylinder means, said solenoid valve means including a four way valve, a three way valve and a two way valve, said two way valve controlling fluid flow to said lift cylinder, said three way valve alternatively directly fluid flow to said two way valve and one of said angling cylinder means, said four way valve controlling flow to said three way valve and the other of said angling cylinder means, said four way, three way and two way valves being selectively operable to provide a first mode of operation wherein said four way valve directs fluid flow only to said three way valve, said three way valve directing flow to said two way valve, and said two way valve directs fluid flow to said lift cylinder, a second mode of operation wherein said two way valve directs fluid returning from said lift cylinder means to said three way valve, said three way valve directs said return fluid flow to said four way valve, and said four way valve directs said return fluid flow to said reservoir, a third mode of operation wherein said three way valve interrupts flow to said two way valve and establishes a flow path to one of said angling cylinder means, said four way valve establishes a flow path from said pump to said three way valve and from said other angling cylinder means to said reservoir, and a fourth mode of operation wherein said three way valve interrupts flow to said two way valve and establishes a path to one of said angling cylinder means, and said four way valve establishes a flow path from said pump to the other of said angling cylinder means and a flow path from said reservoir to said three way valve.

14. The hydraulic system of claim 13 including cushion valve means between said angling cylinder means and operative to establish a flow path from the angling cylinder means connected to said pump to said other angling cylinder means when a predetermined force is applied to said angling cylinder means connected to said pump which is in opposition to the fluid pressure from said pump.

15. The hydraulic system of claim 14 including adjustable means in the passage from said two way valve to said lift cylinder means for adjusting the rate of flow in that passage.

16. A hydraulic system comprising, in combination, a working unit, means supporting said working unit for selective movement about a horizontal axis and a vertical axis, first fluid operated means connected to said working unit for moving said unit about said horizontal axis, second fluid operated means connected to said working unit for selectively moving said unit in opposite directions about said vertical axis, fluid means, a source of fluid, pump means associated with said fluid source and connected to said fluid valve means for directing fluid under pressure to said valve means, said fluid valve means including, first valve means connected to said first and second fluid operated means, second valve means connected to said second fluid operated means, said first valve means, and said pump means, and third valve means connected to said first fluid operated means and said second valve means, said second valve means alternatively connecting said pump means to said second fluid operated means for producing movement in one direction and to said first valve means, said first valve means operative to alternatively connect said pump means to said second fluid operated means and to said first fluid operated means, when connected to said second fluid operated through said first valve means said second fluid operated means moving in an opposite direction, and said second valve means further operative to selectively connect said first and second fluid operated means to said fluid source independent of said pump means.

17. The hydraulic system of claim 16 wherein said first, second and third valves are included in a unitary manifold and said manifold includes means defining fluid flow passages between said valves, said pump means and fluid source are included in unitary power assembly and said unitary power assembly also includes said first fluid operated means, and said manifold is connected to said unitary power assembly.

18. The hydraulic system of claim 17 wherein said working unit is a plow blade, said first fluid operated means is a fluid operated lift cylinder, and said second fluid operated means comprises first and second fluid operated cylinders.

* * * * *